US008529157B2

(12) United States Patent
McKay

(10) Patent No.: US 8,529,157 B2
(45) Date of Patent: Sep. 10, 2013

(54) BRACKET SYSTEM FOR BUILDING A DECK OR DOCK ON A ROCK FACE

(76) Inventor: Michael McKay, Wasaga Beach (CA)

( * ) Notice: Subject to any disclaimer, the term of this patent is extended or adjusted under 35 U.S.C. 154(b) by 196 days.

(21) Appl. No.: 12/958,565

(22) Filed: Dec. 2, 2010

(65) Prior Publication Data

US 2011/0135399 A1 Jun. 9, 2011

Related U.S. Application Data

(60) Provisional application No. 61/265,883, filed on Dec. 2, 2009.

(51) Int. Cl.
*E02B 3/20* (2006.01)

(52) U.S. Cl.
USPC ..... 405/220; 405/218; 248/242

(58) Field of Classification Search
USPC ..... 405/218, 220, 221; 52/126.1, 263; 248/235, 241, 242, 250
See application file for complete search history.

(56) References Cited

U.S. PATENT DOCUMENTS 2,195,579 A * 4/1940 Murdock ..... 248/242
2,483,758 A * 10/1949 Allen ..... 248/242
3,776,498 A * 12/1973 Peters et al. ..... 248/242
5,318,148 A * 6/1994 Franco et al. ..... 248/237
5,524,854 A * 6/1996 McSwain et al. ..... 248/235
5,755,981 A * 5/1998 Payne ..... 249/24
5,775,655 A * 7/1998 Schmeets ..... 248/242
5,865,410 A * 2/1999 Horen ..... 248/242
7,032,268 B2 * 4/2006 Jackson ..... 248/242

* cited by examiner

*Primary Examiner* — Frederick L Lagman
(74) *Attorney, Agent, or Firm* — Elias C. Borges

(57) ABSTRACT

There is disclosed an improved bracket and method for constructing a dock or deck over water on a rocky shore line or on a hard rock face. The present invention includes a base bracket structure having opposite first and second ends, the base bracket being mountable to the rock by a plurality of anchor bolts. A boom having opposite first and second ends is pivotally connected to the base bracket structure adjacent the first end of the angle brackets such that the boom can be set at an angle relative to the base bracket structure, the boom being configured to mount the deck or dock thereon. The improved structure further includes a support rod having opposite first and second ends, the first end of the support rod being pivotally connected to the base bracket structure. The support rod is coupled to the boom by a connector joint located on the boom at a point on the boom between the booms opposite first and second ends. The connector joint is configured to selectively adjust the angle of the boom relative to the base bracket portion such that the boom is substantially horizontal. The connector joint is further configured to fix the boom in place relative to the base bracket portion.

10 Claims, 3 Drawing Sheets

BRACKET SYSTEM FOR BUILDING A DECK OR DOCK ON A ROCK FACE

CROSS REFERENCE TO RELATED APPLICATION

This application claims priority from U.S. provisional patent application No. 61/265,883 filed Dec. 2, 2009, the entirety of which is incorporated herein by reference.

FIELD OF THE INVENTION

The invention relates generally to support brackets and pilings for decks.

BACKGROUND OF THE INVENTION

Building a deck or dock over a lake or other body of water generally requires the use of pilings driven into the bottom of the lake or other body of water adjacent the shore. After driving a sufficient number of pilings into the bottom, the deck could then be built onto the pilings. While this method does provide for a secure structure, driving pilings into the bottom adjacent the shore is often difficult. Furthermore, the pilings, being exposed to the water, can suffer damage as a result of the freezing of the water. Also, this method is particularly difficult to apply in areas where the shoreline consists of hard rock since it is difficult to drive pilings into hard rock.

An alternative approach to building a dock or deck over the water is to use a plurality of pedestal type pillars which rest on the water's bottom, as opposed to being driven into the bottom. While easier to construct, this is not a practical approach for building a permanent structure as the silt and mud on the bottom tends to cause the pillars to shift.

Yet another approach is to build a floating dock or deck which uses a plurality of floats or pontoons to support the decking Again, while convenient, this approach does not lend itself to building a permanent structure. An improved system for building a dock or deck which extends over water which overcomes the disadvantages of the prior art is therefore required.

SUMMARY OF THE INVENTION

In accordance with one aspect of the present invention, there is provided an improved bracket and method for constructing a dock or deck over water on a rocky shore line. The present invention includes a base bracket structure having opposite first and second ends, the base bracket being mountable to the rock by a plurality of anchor bolts. A boom having opposite first and second ends is pivotally connected to the base bracket structure adjacent the first end of the angle brackets such that the boom can be set at an angle relative to the base bracket structure, the boom being configured to mount the deck or dock thereon. The improved structure further includes a support rod having opposite first and second ends, the first end of the support rod being pivotally connected to the base bracket structure. The support rod is coupled to the boom by a connector joint located on the boom at a point on the boom between the booms opposite first and second ends. The connector joint is configured to selectively adjust the angle of the boom relative to the base bracket portion such that the boom is substantially horizontal. The connector joint is further configured to fix the boom in place relative to the base bracket portion.

In accordance with another aspect of the present invention, there is provided an improved support bracket for supporting a deck or dock over a hard rock shore which overcomes the disadvantages of the prior art. The improved support bracket includes a base bracket structure consisting of a pair of identical angle brackets each having a top web, a bottom web extending perpendicularly from the top web, and opposite first and second ends. The pair of angle brackets are arranged in parallel with the opposite first and second ends in alignment and with the top webs adjacent each other. The angle brackets are further oriented such that the bottom webs are coplanar and oriented away from each other. The pair of identical angle brackets are separated from each other by a gap. A plurality of apertures are formed on the bottom web of the angle brackets, said apertures dimensioned to receive anchor bolts for anchoring the base bracket structure to the rock forming the shore. The support bracket further includes a boom having opposite first and second ends, the first end of the boom being pivotally connected to the base bracket structure adjacent the first end of the angle brackets such that the boom can be set at an angle relative to the base bracket. The boom is configured to mount the deck or dock thereon. The mounting bracket further includes a long threaded rod having opposite first and second ends, the first end of the long threaded rod being pivotally connected to the base bracket structure by a pivoting anchor member extending between the angle brackets adjacent the second end of the angle brackets. The long threaded rod is coupled to the boom by a connector joint located on the boom at a point on the boom between the boom's opposite first and second ends. The connector joint is configured to selectively adjust the angle of the boom relative to the base bracket portion such that the boom is substantially horizontal. The connector joint is further configured to fix the boom in place relative to the base bracket portion.

In accordance with another aspect of the present invention, there is provided an improved method for constructing a dock on a rocky shore using a plurality of support brackets as described in the preceding paragraphs. The method includes the steps of drilling a plurality of anchor holes into the rock, the anchor holes each being dimensioned to receive one of the anchor bolts. Each anchor bolt is then secured in its respective hole with an adhesive. A plurality of base bracket structures are then secured to the anchor bolts. The angle of each of the booms is then adjusted such that the booms are all substantially horizontal and coplanar. Finally, the deck or dock is then constructed on top of the booms.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
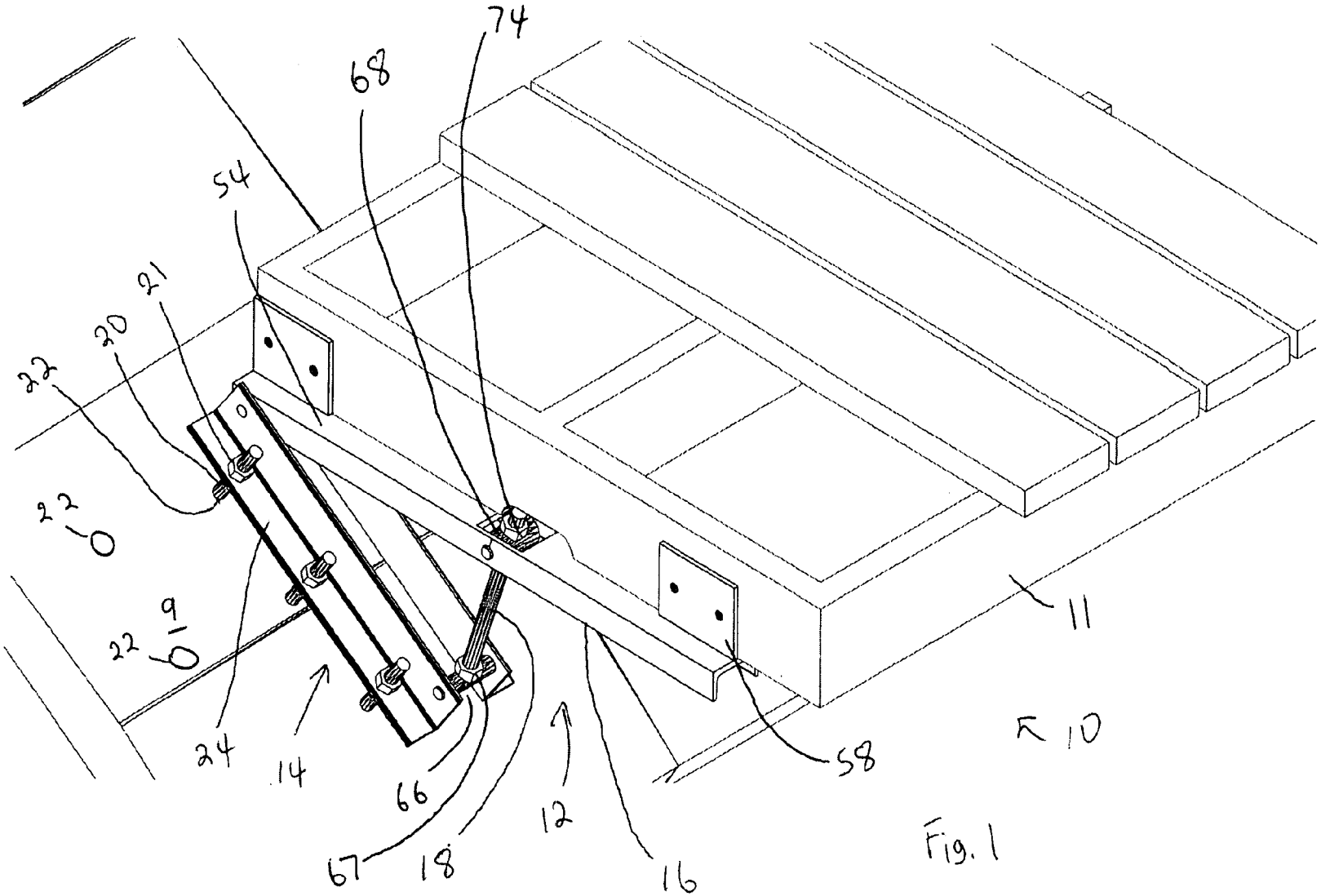
FIG. 1 is a perspective view of a dock constructed using the support bracket and method of the present invention showing the support bracket supporting a deck on a relatively shallow rock face.

Referring firstly to FIG. 1, a deck or dock constructed over a hard rock shore in accordance with one aspect of the present invention is shown generally as item 10 and includes a deck 11 supported on hard rock surface 9 by support bracket assembly 12. Deck 11 is a standard deck preferably made of pressure treated lumber or the like. Hard rock surface 9 is any hard rock as is often found in places such as the Canadian shield. Preferably, hard rock surface 9 is a continuous mass of rock such as granite or basalt or other similar solid hard rock. Support bracket assembly 12 includes base bracket portion 14, a boom portion 16 and an elongated support rod 18. Base bracket portion 14 is bolted to hard rock surface 9 by means of a plurality of anchor bolts 20 and nuts 21. Bottom web portion 24 of the base bracket is provided with a plurality of apertures dimensioned to receive the anchor bolts. Each bolt is secured to the bottom web portion by nuts 21 which are threaded onto each of the bolts both below and above web portion 24 so as to secure the web portion between two nuts. Each bolt 20 is secured in a hole 22 which is drilled several inches into the hard rock surface and then held in place by rock adhesive or cement. To ensure ease of installation, bolts 20 are sufficiently long so as to ensure that base bracket portion 14 is at least an inch or so away from the surface of hard rock surface 9; however, if the hard rock surface is particularly uniform and flat it is possible to mount the base bracket so that the base bracket contacts the hard rock surface.

Figures 3, 4, 5, 6, 7, 8, 9, 10, 11:
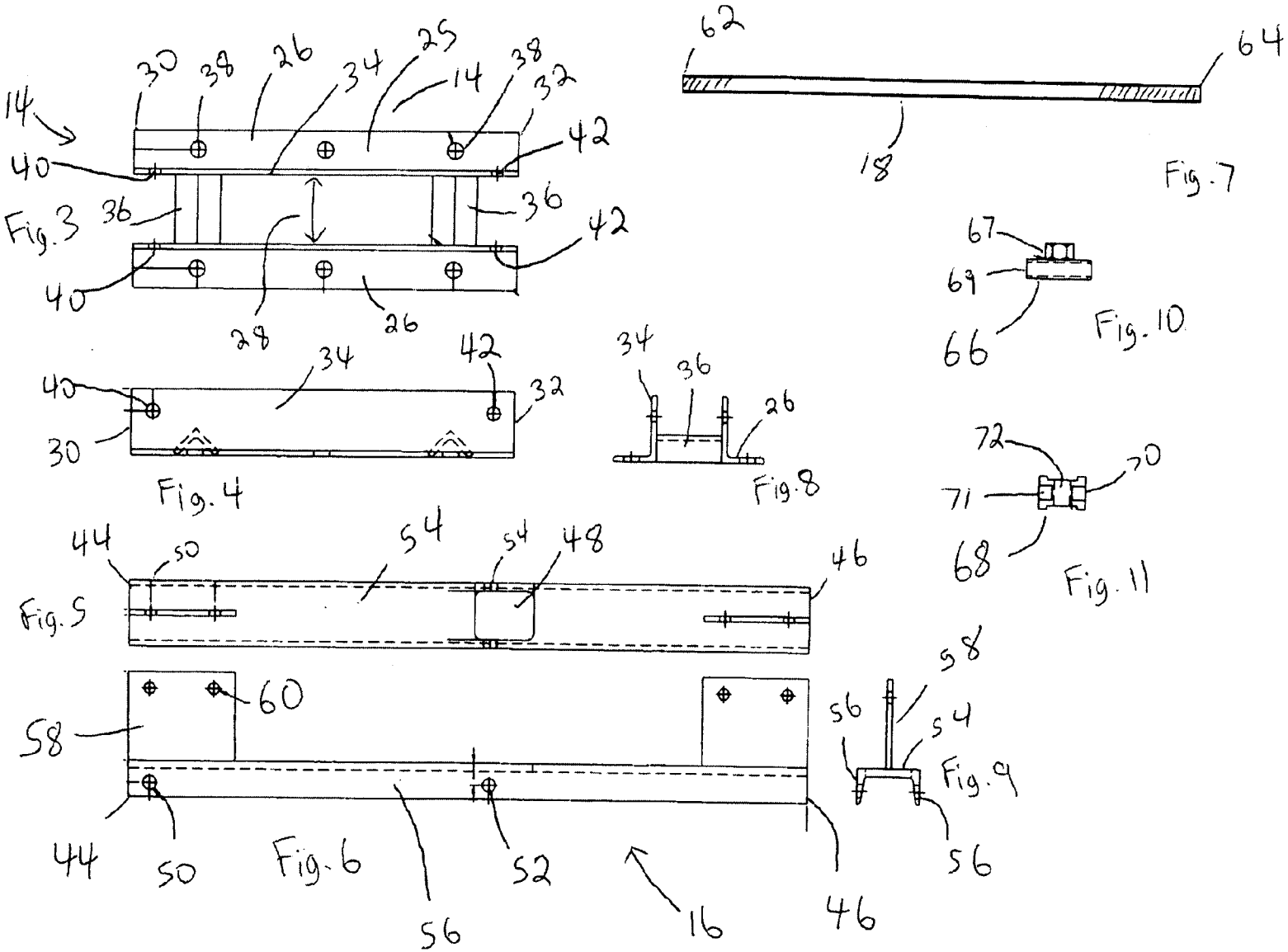
FIG. 3 is a top view of the base bracket portion of the support bracket of the present invention.
FIG. 4 is a side view of the base bracket portion of the support bracket of the present invention.
FIG. 5 is a top view of the boom portion of the present invention.
FIG. 6 is a side view of the boom portion of the present invention.
FIG. 7 is a side view of the support rod portion of the present invention.
FIG. 8 is a front view of the base bracket portion of the support bracket of the present invention.
FIG. 9 is a front view of the boom portion of the present invention.
FIG. 10 is a side view of the pivoting anchor member of the present invention.
FIG. 11 is a side view of the connector joint portion of the present invention.

Referring now to FIGS. 3, 4 and 8, base bracket 14 is formed from a pair of steel angle brackets 25 each having a top web portion 34 and a bottom web portion 26 and opposite ends 30 and 32. The pair of angle brackets are held in parallel with their bottom web portions in coplanar arrangement and secured by support members 36 which are welded to each of the angle brackets. A plurality of apertures 38 are formed on the bottom web portions 26 of each angle bracket, the apertures being dimensioned to receive anchor bolts 20 (see FIG. 1). Apertures 40 and 42 are provided on the top web portions 34 of angle brackets 25 adjacent ends 30 and 32, respectively. As will be explained below, aperture 40 is formed to permit the pivotal connection of boom 16 to base bracket 14 while aperture 42 permits pivotal connection of support rod 18 to the base bracket.

Preferably angle brackets 25 and support members 36 are made of galvanized steel to inhibit the corrosion of the brackets. Alternatively, the entire bracket 14 could be galvanized after assembly. It is also possible to build support bracket 14 from some other metal which is not prone to rusting, such as stainless steel or even aluminum; however, galvanized steel provides a good balance of strength, corrosion resistance and cost.

Referring now to FIGS. 5, 6, and 9, boom 16 is pivotally coupled to bracket 14. Boom 16 has opposite ends 44 and 46 and preferably consists of an elongated steel bracket having a U shaped profile with a top web 54 and side webs 56. Apertures 50 and 52 are formed on side webs 56 adjacent end 44 and mid way between ends 44 and 46, respectively. Boom 16 is pivotally connected to base bracket 14 by placing end 44 of the boom between angle brackets 25, coaxially aligning apertures 40 of the base bracket with apertures 50 of the boom and then passing a bolt (not shown) or other similar structure through the aligned apertures. Boom 16 further includes flanges 58 having apertures 60 formed thereon. Flanges 58 assist in mounting a deck structure onto boom 16. Boom 16 may be made of galvanized steel or some other preferably corrosion resistant strong metal.

Referring now to FIGS. 3, 5, 7, 10 and 11, support rod 18 consists of an elongated rod having opposite ends 62 and 64. Preferably, rod 18 is cylindrical with end 64 of rod 18 being threaded. Preferably, the entire rod is threaded. First end 62 of rod 18 is pivotally connected to base bracket 14 by means of a pivoting anchor member 66. Anchor member 66 consists of a steel tube 69 having a threaded receiver 67 welded thereon. Anchor member 66 is mounted between angle brackets 25 by aligning tube 69 with apertures 42 formed in the angle bracket and then passing a bolt (not shown) or other member through the tube and the apertures. End 62 can then be screwed into threaded receiver 67, although it is also possible to secure the rod to the receiver by other means such as welding. Rod 18 is further coupled to boom 16 by means of connector joint 68 which consists of a strong tubular member having passage 70, 71 and 72. Passage 70 passes completely through connector joint 68. End 64 is passed through passage 72 and connector joint 68 is secured to boom 16 by coaxially aligning passages 71 and 72 with apertures 52 in the boom and then securing the connector joint by bolts (not shown). Aperture 48 formed in boom 16 permits end 64 of rod 18 to pass through the boom.

Figure 2:
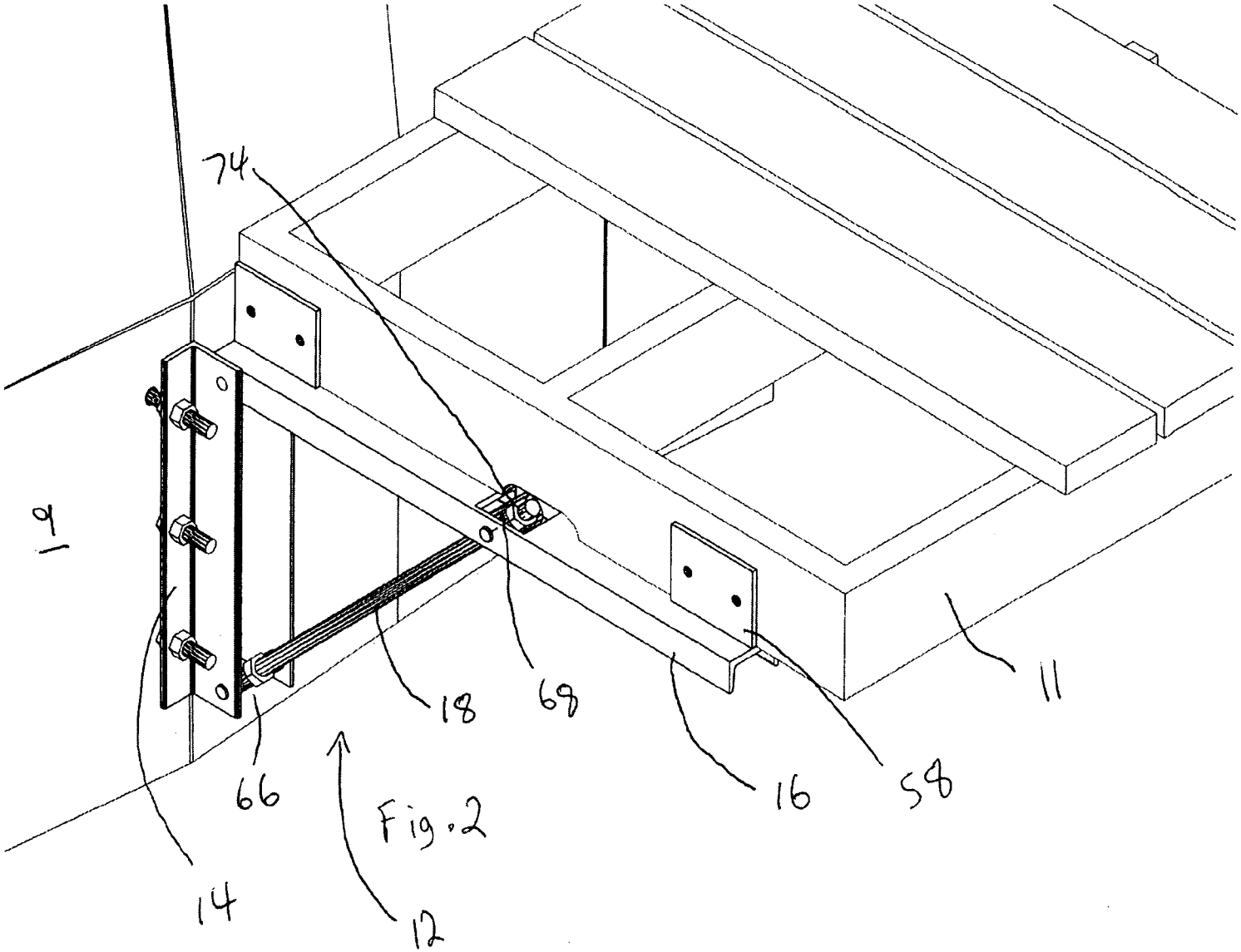
FIG. 2 is a perspective view of a dock constructed using the support bracket and method of the present invention showing the support bracket supporting a deck on a relatively steep rock face.

Referring back to FIG. 1, when fully assembled, boom 16 of bracket 14 can be tilted relative to bracket base 14. Support rod 18 is used to adjust the angle of boom 16 relative to base bracket 14 and to secure the boom in place. After base bracket 14 is secured to hard rock face 9, boom 16 can be adjusted by simply passing rod 18 through the connector joint 68 until boom 16 is horizontal. The boom is secured by means of nuts 74 positioned above and below connector joint 68 which act to lock the support rod and the boom in position. Any portion of rod 18 projecting past the top of boom 16 can simply be cut off. Deck 11 can then be built on top of boom 16 and secured thereto by flanges 58. As can be seen from FIG. 2, since boom 16 is pivotally connected to base bracket 14, boom 16 can be maintained at a horizontal angle even if hard rock surface 9 is nearly vertical. This greatly increases the flexibility of bracket 14 allowing it to be used to construct a dock or deck even where the rock surface is uneven.

Referring back to FIG. 1, to construct a deck or dock structure over a hard rock surface 9, a plurality of apertures 22 are first drilled into the hard rock. The depth of the apertures depends on the structural load to be supported on the deck (or dock) and the composition of the rock forming surface 9. The larger the load, the deeper apertures 22 have to be. Preferably, apertures 22 are several inches to a foot or more in depth. After the apertures are formed, bolts 20 are inserted into the apertures 22 and held in place by rock adhesive or cement. Suitable adhesives and cements are readily available in the market. Bolts 20 are several inches longer than the depth of apertures 22 so that the bolts project from the rock face by several inches. After the adhesive/cement has set, base bracket 14 is then secured to bolts 20 by nuts 21. Nuts 21 are threaded onto bolts 20 both below and above bottom web 24 with sufficient torque to rigidly secure base bracket 14 to rock face 9. Boom 16 may then be mounted to base bracket 14 assuming it was not already attached to the base bracket when the base bracket was mounted to the rock face. Boom 16 is then pivoted until it is substantially horizontal and then locked in place by securing nuts 74 to rod 18 both above and below connector joint 68. Sufficient torque is applied to nuts 74 to firmly lock the rod and boom together. Any length of support rod 18 which projects above boom 16 may then be cut off. This procedure will have to be repeated several times so that a plurality of support brackets 12 are secured to rock face 9 each with its boom in a horizontal orientation. Deck 11 can then be assembled on top of booms 16 as required.

The present invention has several advantages over the prior art. In particular, the support brackets, having pivotally adjustable booms are capable of securing a deck to a hard rock surface which is at an angle from the horizontal and or which is uneven. The brackets can adjust to any angle as required to provide a firm foundation upon which a deck can be built.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A support structure for anchoring a deck to a rock, the support structure comprising:

a a base bracket structure comprising pair of identical angle brackets each having a top web, a bottom web extending perpendicularly from the top web, and opposite first and second ends, the pair of angle brackets being arranged in parallel with the opposite first and second ends in alignment and top webs adjacent each other, the bottom webs being coplanar and oriented away from each other, the pair of identical angle brackets being separated by a gap;

b a plurality of apertures formed on the bottom web of the angle brackets, said apertures dimensioned to receive anchor bolts for anchoring the base bracket structure to the rock;

c a boom having opposite first and second ends, the first end of the boom being pivotally connected to the base bracket structure adjacent the first end of the angle brackets such that the boom can be set at an angle relative to the base bracket structure, the boom being configured to mount the deck thereon;

d a long threaded rod having opposite first and second ends, the first end of the long threaded rod being pivotally connected to the base bracket structure by a pivoting anchor member extending between the adjacent angle brackets adjacent the second end of the angle brackets, and e the long threaded rod being coupled to the boom by a connector joint located on the boom at a point on the boom between the booms opposite first and second ends, the connector joint configured to selectively adjust the angle of the boom relative to the base bracket portion such that the boom is substantially horizontal and fix the boom in place relative to the base bracket portion.

2. The support structure of claim 1 wherein the first end of the boom is pivotally connected to the base bracket portion between the angle brackets.

3. The support structure of claim 1 wherein the angle of the boom relative to the base bracket portion is fixed by one or more threaded nuts threaded to the long threaded rod.

4. The support structure of claim I wherein the anchor bolts are sufficiently long to anchor the base bracket at a distance of at least a few centimeters from the rock.

5. The support structure of claim 1 wherein the pair of angle brackets are mounted to each other by a pair of support members extending between the angle brackets.

6. A support structure for anchoring a deck to a rock, the support structure comprising:

a a base bracket structure having opposite first and second ends;

b the base bracket being mountable to the rock by a plurality of anchor bolts;

c a boom having opposite first and second ends, the first end of the boom being pivotally connected to the base bracket structure adjacent the first end of the base brackets such that the boom can be set at an angle relative to the base bracket, the boom being configured to mount the deck thereon;

d a support rod having opposite first and second ends, the first end of the support rod being pivotally connected to the base bracket;

e the support rod being coupled to the boom by a connector joint located on the boom at a point on the boom between the booms opposite first and second ends, the connector joint configured to selectively adjust the angle of the boom relative to the base bracket such that the boom is substantially horizontal, the connector joint being further configured to fix the boom in place relative to the base bracket, and f wherein the base bracket comprises a parallel pair of angle brackets each having a top web and a bottom web projecting perpendicularly from the top web, both the boom and the support rod being pivotally connected between the angle brackets.

7. The support structure of claim 6 wherein the second end of the support rod is threaded and wherein the second end of the support rod is fixed to the connector joint by at least one threaded nut.

8. The support structure of claim 6 wherein the bottom webs are provided with a plurality of apertures, each aperture dimensioned to receive one of the anchor bolts.

9. The support structure of claim 8 wherein the anchor bolts are sufficiently long to anchor the base bracket at a distance of at least a few centimeters from the rock.

10. The support structure of claim 6 wherein the angle brackets are rigidly coupled to each other by a pair of support members extending between the angle brackets.

* * * * *